United States Patent [19]

Schmitt et al.

[11] 4,432,858

[45] Feb. 21, 1984

[54] MONOPOLAR FILTER-PRESS TYPE ELECTROLYZER

[76] Inventors: Helmut Schmitt, Eintrachtstr. 28, 4600 Dortmund 1; Helmuth Schurig, Jahnstr. 26, 4755 Holzwickede; Bernd Strasser, Freiligrath-Str. 6, 4700 Hamm Westf., all of Fed. Rep. of Germany

[21] Appl. No.: 402,312

[22] Filed: Jul. 27, 1982

[30] Foreign Application Priority Data

Aug. 4, 1981 [DE] Fed. Rep. of Germany ..... 3130742

[51] Int. Cl.[3] ..... C25B 9/00; C25B 11/03

[52] U.S. Cl. ..... 204/257; 204/279; 204/284

[58] Field of Search ..... 204/253–258, 204/263–266, 279, 283–284, 98, 128

[56] References Cited

U.S. PATENT DOCUMENTS 3,657,099 4/1972 Seko et al. ..... 204/253

4,252,628 2/1981 Boulton et al. ..... 204/258 X 4,339,324 7/1982 Haas ..... 204/257 X

*Primary Examiner*—Donald R. Valentine

*Attorney, Agent, or Firm*—Fraser, Barker, Purdue & Clemens

[57] ABSTRACT

An electrolyzer for producing an aqueous alkali hydroxide solution, halogen, and hydrogen from an aqueous halogenide-bearing electrolyte. The electrolyzer includes a plurality of alternating anolyte and catholyte chambers each formed by a pair of anode plates and cathode plates, respectively. Seals are provided between and around the perimeter of the two anode and cathode plates to define the chambers. A flat membrane member, permeable to ions is disposed between adjacent anode and cathode plates. The anode and cathode plate and seals include passages for the flow of process fluids. Each anode and cathode plate comprises an active portion permeable to the flow of gas and liquid and an inactive portion impermeable to the flow of gas and liquid.

6 Claims, 3 Drawing Figures

MONOPOLAR FILTER-PRESS TYPE ELECTROLYZER

BACKGROUND OF THE INVENTION

The invention relates to a monopolar filter-press type electrolyzer suitable for the production of an aqueous alkali hydroxide solution (cell liquor) as well as halogen and hydrogen from an aqueous halogenide-bearing electrolyte (brine). The electrolyzer consists of two end plates with tie-bars, a plurality of alternating anolyte and catholyte chambers, i.e., electrolyte chambers, each having two anode and cathode plates which are separated by a flat membrane permeable to ions.

The process fluids such as brine, cell liquor, halogen, and hydrogen used in this filter-press type electrolyzer must be routed such as to prevent any significant chemical attack on the metal of the anode and cathode plates.

Patent DE-OS No. 28 09 33 describes a membrane electrolyzer of the filter-press type consisting of a plurality of successive anode and cathode plates separated by membranes and spaced by means of intermediate plates.

The membrane cell described above possesses a large number of different components and seals.

SUMMARY OF THE INVENTION

The object of the present invention is to reduce the number of different components and, consequently, the number of seals.

According to the invention, the anode and cathode plates not only have an electrolytically active metal component but also a nonmetallic component with inlet and outlet ducts for the process fluids. The process fluids flow in either direction through corrugated bores which connect the ducts with the electrolyte chambers. The thickness of the intermediate plates arranged between each membrane and anode or cathode plate depends on the membrane spacing.

The advantages achieved by the invention are that the number of components and, consequently, the number of seals is substantially reduced. Fabrication and assembly of the electrolyzer are thus facilitated considerably.

The materials of the electrolyzer components correspond to the present state of technology and are not specified in detail.

BRIEF DESCRIPTION OF THE DRAWINGS

An embodiment of the invention is illustrated in accompanying drawings and described in more detail below when considered in light of the drawings, in which.

DETAILED DESCRIPTION OF THE PREFERRED EMBODIMENT

Figure 1:
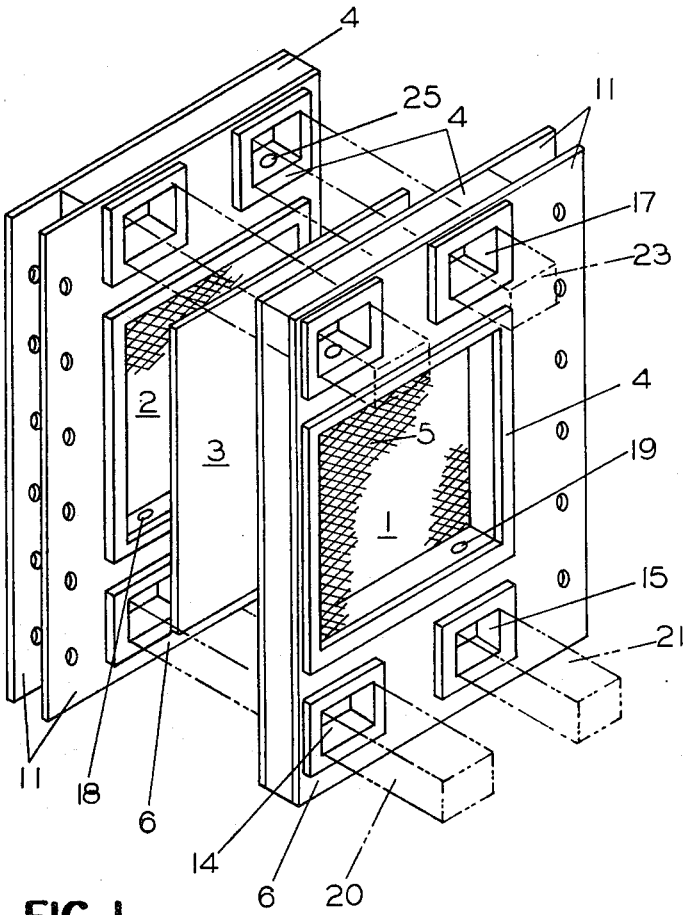
FIG. 1 is an exploded perspective view of an electrolyzer unit constructed in accordance with the invention.

Referring to FIG. 1, the active part of the electrolyzer includes an anode plate 1, a cathode plate 2, a membrane member 3, and seals 4. The anode and cathode plates 1 and 2, respectively, are formed of different metals, and includes an active surface area 5 having a microstructure permeable to gas and liquid. An inactive part 6 is impermeable, but has at least four bores 7, 8, 9, and 10 (see FIG. 3) for the passage of brine, cell liquid, halogen, and hydrogen. In addition, the inactive part of each plate 1 and 2 is provided with electrical connection portions 11 for connecting bus bars thereto. Membrane member 3, separating the plates 1 and 2, insulates the plates from each other and forms reaction chambers 12 and 13 for brine and cell liquid. Any cation-exchange material, for instance with adequate plies or coating can be used as the membrane member 3. The seals 4 are normally made of an elastomer such as natural or synthetic rubber. In this case they are double U-shaped sections and cover the perimeter of the anode or cathode plates to form the anolyte chamber 12 and catholyte chamber 13, see FIG. 2. In lieu of a direct connection between the anolyte and catholyte chambers 12 and 13 for the process fluids, the seals 4 are provided in the known manner with passages 14, 15, 16, and 17 with the ducts 14 and 15 including transverse holes 18 and 19 opening into the reaction chambers 12 and 13, respectively (see FIG. 1).

Figure 2:
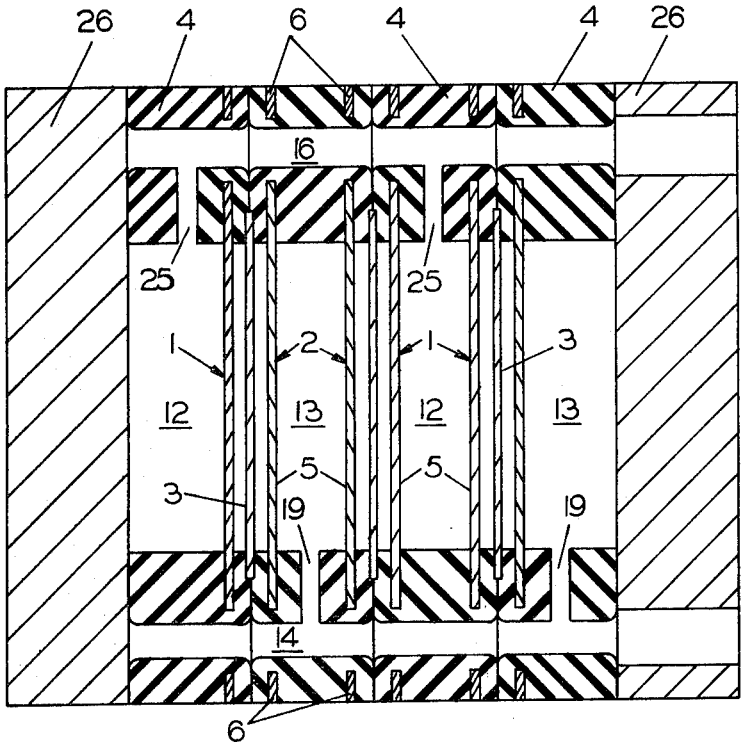
FIG. 2 is a cross-sectional view of several anolyte and catholyte chambers.

The electrolyzer is assembled in the known manner by means of end plates 26 with tie-bars (not shown), the end plates being inactive or acting as anodes or cathodes. As illustrated in FIG. 2, the monopolarfilter-press type electrolyzer comprises a plurality of electrolyzer elements consisting of two anode plates 1 which form the anolyte chamber 12, and two cathode plates 2 constituting the catholyte chamber 13. A membrane member 3 separates the anode and cathode plates from each other. Preferably, the spacing between the two anode and the two cathode plates is from 5 to 50 mm. The passages 14, 15, 16, and 17 are formed by the seals 4 extending through the bores 7, 8, 9, and 10, extending through, between, and around the plates. The passages 14 and 15 in the bottom part of the plates 1 and 2, for instance, constitute a duct 20 (FIG. 1) for feeding brine to the cell and via transverse hole 18, to the anolyte chamber 12. The cell liquor flows through a duct 21 formed by the orifices 8 and the necessary seals 4 via transverse hole 19 into the catholyte chamber 13.

Halogen with a minor content of depleted brine and hydrogen with a minor content of alkali hydroxide are evacuated via a halogen duct 22 and hydrogen duct 23 formed by the bores 9 and 10 and the necessary seals 4 in a similar manner as well as via transverse holes 24 and 25, respectively (FIG. 1). The seals 4 used for the chambers and ducts are such that they seal one electrolyzer element against the other and insulate the anode plates 1 against the cathode plates 2. According to the invention, the plates 1 and 2, membranes 3, and seals 4 are positioned in such a manner that they form the electrolyte chambers 12 and 13 and the passages 14, 15, 16, and 17, including the necessary connections.

Figure 3:
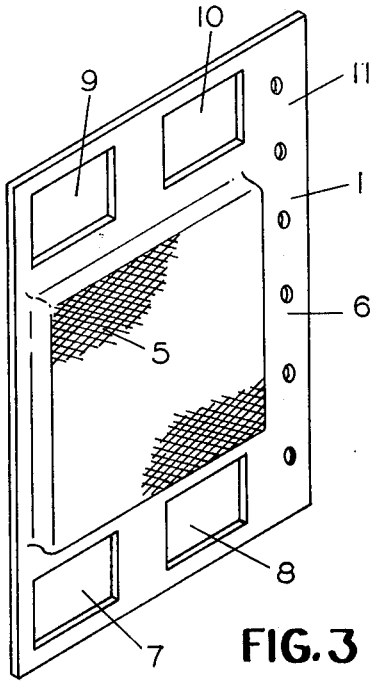
FIG. 3 is a perspective view of an electrode plate structure suitable for both the anode and cathode plates.

Referring to FIG. 3, the inactive surface area 6 of the anode and cathode plates 1 and 2 is plane-parallel to the active part 5 which protrudes from the inactive part 6. Thus the lips and webs of the seal which, for instance, may be double U-shaped will have approximately the same thickness.

What is claimed is:

1. A monopolar filter-press type electrolyzer for the production of an aqueous alkali hydroxide solution, halogen, and hydrogen from an aqueous halogenide-bearing electrolyte; the electrolyzer comprising: two end plates; a plurality of alternating anolyte and catholyte chambers each formed by two anode and two cathode plates and seals extending around the perimeters of the plates; a membrane permeable to ions separating the chambers; said seals having portions extending between the chambers for mounting said membrane and insulating said anode and cathode plates from each other; said anode plates, cathode plates, and seals having orifices which constitute inlet and outlet ducts for process fluids when said plates, membranes, and seals are assembled; each said anolyte and catholyte chamber including two anode and cathode plates having an active part permeable to gas and liquids, an inactive part impermeable and including at least four bores, said bores and said seals covering the inactive part of said anode and cathode plates and including at least four passages.

2. The electrolyzer defined in claim 1, wherein said seals covering the perimeters of said anode and cathode plates are U-shaped.

3. The electrolyzer defined in claim 1, wherein said seals surrounding said anode and cathode plates are double U-shaped and each said seal joins two anode and cathode plates.

4. The electrolyzer defined in claim 3, wherein the center portion of said seal includes means for reinforcing said center portion for forming a spacer separating pairs of anode and cathode plates.

5. The electrolyzer defined in claims 1, 2, 3, or 4, wherein spacing between two said anode and two said cathode plates are 5 to 50 mm.

6. The electrolyzer defined in claim 1, wherein the inactive portion of the said anode and said cathode plates is plane-parallel to the active part and protrudes from the inactive part.

* * * * *